US010376727B2

(12) United States Patent
Fitzpatrick

(10) Patent No.: US 10,376,727 B2
(45) Date of Patent: Aug. 13, 2019

(54) MOUNTABLE EXERCISE BAR ASSEMBLY

(71) Applicant: Paul Michael Fitzpatrick, Brewster, MA (US)

(72) Inventor: Paul Michael Fitzpatrick, Brewster, MA (US)

( * ) Notice: Subject to any disclaimer, the term of this patent is extended or adjusted under 35 U.S.C. 154(b) by 0 days.

(21) Appl. No.: 15/618,029

(22) Filed: Jun. 8, 2017

(65) Prior Publication Data

US 2017/0354838 A1 Dec. 14, 2017

Related U.S. Application Data

(60) Provisional application No. 62/347,683, filed on Jun. 9, 2016.

(51) Int. Cl.

| | |
|---|---|
| ***A63B 23/12*** | (2006.01) |
| ***A63B 1/00*** | (2006.01) |
| ***A63B 21/00*** | (2006.01) |
| ***A63B 21/068*** | (2006.01) |
| ***A63B 21/16*** | (2006.01) |
| ***A63B 23/02*** | (2006.01) |
| *A63B 23/00* | (2006.01) |

(52) U.S. Cl.

CPC ..... *A63B 1/00* (2013.01); *A63B 21/00047* (2013.01); *A63B 21/068* (2013.01); *A63B 21/16* (2013.01); *A63B 21/4035* (2015.10); *A63B 23/0216* (2013.01); *A63B 23/1218* (2013.01); *A63B 23/1227* (2013.01); *A63B 2023/006* (2013.01); *A63B 2208/029* (2013.01); *A63B 2210/50* (2013.01); *A63B 2225/09* (2013.01); *A63B 2225/093* (2013.01)

(58) Field of Classification Search

CPC ..... A63B 21/169; A63B 21/1636; A63B 1/00; A63B 21/00047; A63B 21/068; A63B 21/16; A63B 21/4035; A63B 23/0216; A63B 23/1218; A63B 23/1227; A63B 2023/006; A63B 2208/029; A63B 2210/50; A63B 2225/09; A63B 2225/093

See application file for complete search history.

(56) References Cited

U.S. PATENT DOCUMENTS

| | | | | |
|---|---|---|---|---|
| 2,394,203 A * | 2/1946 | Pruder | A01M 31/02 | 108/135 |
| 2,842,300 A * | 7/1958 | Johnson | A63B 27/00 | 182/133 |
| 4,344,619 A * | 8/1982 | Szabo | A63B 21/0615 | 248/161 |
| 4,529,191 A * | 7/1985 | Miller | A63B 1/00 | 211/123 |

(Continued)

*Primary Examiner* — Joshua Lee

(74) *Attorney, Agent, or Firm* — Timothy W. Fitzwilliam

(57) ABSTRACT

A modular, easily constructible exercise assembly providing pull-up type exercise routines is disclosed. This particular solution is designed to be secured to a stationary upright object, or anchor. The unique construction of the exercise assembly can be broken down into base components to conveniently fit into a back pack. Its specific structure and design is optimized to limit wear and material failure. Additionally, adjustability is provided to various components as detailed herein. For example, an exercise bar can articulate at different angles and extend and lengthen as selected by a user. Also, a securing bar is adjustable for coupling the exercise assembly to different sized stationary objects.

11 Claims, 6 Drawing Sheets

(56) References Cited

U.S. PATENT DOCUMENTS 4,595,076 A * 6/1986 Gober ..... A63B 27/00 182/135
4,620,701 A * 11/1986 Mojden ..... A63B 3/00 482/142
4,809,815 A * 3/1989 Wallace ..... A63B 27/00 182/133
5,046,722 A * 9/1991 Antoon ..... A63B 17/00 482/39
5,588,942 A * 12/1996 Dillard ..... A63B 21/4035 482/106
5,689,999 A 11/1997 Wiley et al.
6,179,752 B1 * 1/2001 Chang ..... A63B 21/0083 482/52
6,508,743 B1 * 1/2003 Fortin ..... A63B 1/00 482/38
7,066,866 B1 * 6/2006 Mobley ..... A63B 1/00 482/40
9,427,611 B1 * 8/2016 Balentine ..... A63B 1/00
2004/0127339 A1 7/2004 Finn
2006/0019806 A1 1/2006 Mikulski
2006/0252613 A1 * 11/2006 Barnes ..... A63B 21/00072 482/95
2007/0149369 A1 * 6/2007 Finch ..... A63B 21/00047 482/140
2009/0253559 A1 * 10/2009 Maresh ..... A63B 21/00072 482/93
2013/0178338 A1 * 7/2013 Ross ..... A63B 1/00 482/40
2013/0225373 A1 * 8/2013 Poat ..... A63B 21/1636 482/40
2013/0244836 A1 * 9/2013 Maughan ..... A63B 21/1645 482/40
2016/0166874 A1 * 6/2016 Sheeler ..... A63B 21/1627 482/40
2016/0256720 A1 * 9/2016 Grant ..... A63B 21/1636
2017/0209737 A1 * 7/2017 Tadi ..... A63B 71/0009

* cited by examiner

MOUNTABLE EXERCISE BAR ASSEMBLY

PRIORITY CLAIM

This patent application claims benefit of the priority date of U.S. Prov. Pat. App. Ser. No. 62/347,683 filed on Jun. 9, 2016, entitled "Mountable Exercise Assembly and Method of Use Thereof," accordingly, the entire contents of this patent application is hereby expressly incorporated by reference.

BACKGROUND OF THE INVENTION

Field of the Invention

The present invention pertains generally exercise devices and methods of employing such providing a personal workout. More particularly, the invention relates to an exercise bar assembly apparatus, portable and mountable to a stationary object, for performing pull-ups, chin-ups dips, and the like.

Description of the Prior Art

It is well known that regular physical activity is beneficial to overall health. In fact, routine exercise is proven to provide numerous benefits, including, but not limited to, prevention of excess weight gain, maintenance of healthy body fat percentage, increased energy, and improved mood and sleep quality. For people with busy schedules, finding the time and location to exercise is often inconvenient. For example, most portable exercise devices are heavy and bulky making such devices difficult to transport and assemble. As an added problem, many of these exercise devices are expensive to maintain due to numerous moving and intricate parts.

Also known are the many different exercises that exist for toning and strengthening numerous different muscle groups; as are known those that utilize own bodyweight instead of weights or resistance devices. Advantages for each are unique, however, the present invention seeks to provide for pull-up, chin-up, dips, and other hanging exercises to further include stretching and some core/leg lift type exercises.

Examples of portable exercise devices in the prior art include U.S. Pub. Pat. App. No. 2006/0019806, entitled "Portable Exercise Assembly," invented by Mikulski and U.S. Pub. Pat. App. No. 2004/0127339, entitled "Portable Device for Assisting Chin-Up and Dip Exercises" invented by Finn. Both Mikulski and Finn recognize disadvantages with bulky size and weight of exercise apparatuses resulting in the inability of those utilizing such exercise equipment to travel or easily relocate the device. Further, such problem is specifically recognized by those who train on a regular or strictly scheduled basis. However, neither solution uses existing stationary objects for stability, or the anchor. Also, Mikulski uses resistance training and Finn employs rubber or elastic material for assisted training. Conversely the present invention simply provides for unassisted, own body weight repetitions to work particular muscle groups.

Also importantly, very few portable exercise devices are specifically designed to configure with a stationary object commonly referred to as an anchor. Some of these examples use a door frame or door jam as the anchor. However, there remains a need to provide a suitable portable exercise assembly utilizing a tree, or any upright elongated structure as the anchor. Hence, it is an object of the present invention to provide such device having components easily disassembled and transportable, having similar interchangeable parts. It is further an object of the present invention to provide a solution with an adjustable exercise bar for various exercises also considering size and/or preference of a user. It still further an object of the present invention to provide a design that will yield optimum wear and longevity. Yet still, it is an object of the present invention to provide a solution using own weight against which muscle groups work; hence the solution is devoid of elastic or rubber adding unnecessary complexity to the design. It is yet further an object of the present invention to provide a solution that is cost effective and commercially viable.

BRIEF SUMMARY OF THE INVENTION

The present invention specifically addresses and alleviates the above mentioned deficiencies, more specifically, the present invention, in a first aspect, is a mountable exercise bar assembly, for mounting to a substantially stationary object comprising: a base plate having a mating surface (e.g. flat) for contacting and mating to the stationary object; a securing bar coupled to the base plate and extending at least partially around the stationary object for securing and stabilizing the mountable exercise assembly; an extension arm extending outwardly from the base plate; an exercise bar, in turn, extending substantially laterally (also preferred horizontally) from the outwardly extending extension arm, the exercise bar for performing a plurality of exercises by a user. In the most general sense, exercise bar assembly comprises a plurality of components being detachable for assembly and disassembly for stowage and transport.

The mountable exercise bar assembly, herein, for mounting to a substantially stationary is additionally characterized in that the base plate further comprises a parallel pair of opposing lateral side plates extending outwardly from the (flat) mating surface. The securing bar is additionally connected to the base plate via the opposing pair of lateral side plates and the extension arm connects to the base plate via the securing bar. The securing bar has a dual purpose in that it also acts as a pin fulcrum for the extension arm, wherein the extension arm further rotates about the fulcrum. The rotation provides vertical adjustment to a user wherein the extension arm is locked in place.

The mountable exercise bar assembly in this aspect is additionally characterized in that the extension arm further comprises: a first steel tubular extension arm; and a second steel tubular extension arm having a telescoping relationship with the first steel tubular each having a plurality of holes equally spaced apart that align at various extension lengths.

The mountable exercise bar assembly in this aspect is additionally characterized such that the exercise bar further comprises a handle bar section extending laterally with respect to the extension arm, the handle bar section further having elbow portions proving a partially curved shape, similar in shape to a bicycle handle bar. Outwardly from the handle bar section a first articulating member is coupled to a first end of the handle bar section via a first joint; a second articulating member is coupled to a second end of the handle bar section via a second joint; a left hand bar is slidingly and adjustably connected to the first articulating member as to selectively extend the left hand bar; and a right hand bar is slidingly and adjustably connected to the second articulating member as to selectively extend the right hand bar, the first and second articulating members providing a range of angle adjustment an a top aspect to the exercise bar.

The mountable exercise bar assembly is additionally characterized as further comprising a stabilizing strap coupled to a lower portion of the base plate and extending entirely around the stationary object. In the preferred embodiment, the stabilizing bar is configured above the stabilizing strap. Further to the base plate the opposing pair of lateral side plates each comprises a tab extending toward one another and contacting each other and wielded together providing additional structural integrity to the base plate.

The extension arm herein is additionally characterized wherein the extension arm is rotatably coupled to the base plate wherein a horizontal position corresponds to a nine o'clock position and wherein the extension arm further has past horizontal ten and eleven o'clock positions and further the extension arm has before horizontal eight, seven and six o'clock position, the six o'clock being the straight up and down vertical position. Lastly, the pair of opposing lateral sides each comprises a carve-out, the carve-out providing ascetically aesthetically pleasing design, the carve-out further comprising a scripted source identifier.

While the apparatus and method has or will be described for the sake of grammatical fluidity with functional explanations, it is to be expressly understood that the claims, unless expressly formulated under 35 USC § 112, or similar applicable law, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC § 112 are to be accorded full statutory equivalents under 35 USC § 112, or similar applicable law. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF PREFERRED EMBODIMENTS

Figure 1:
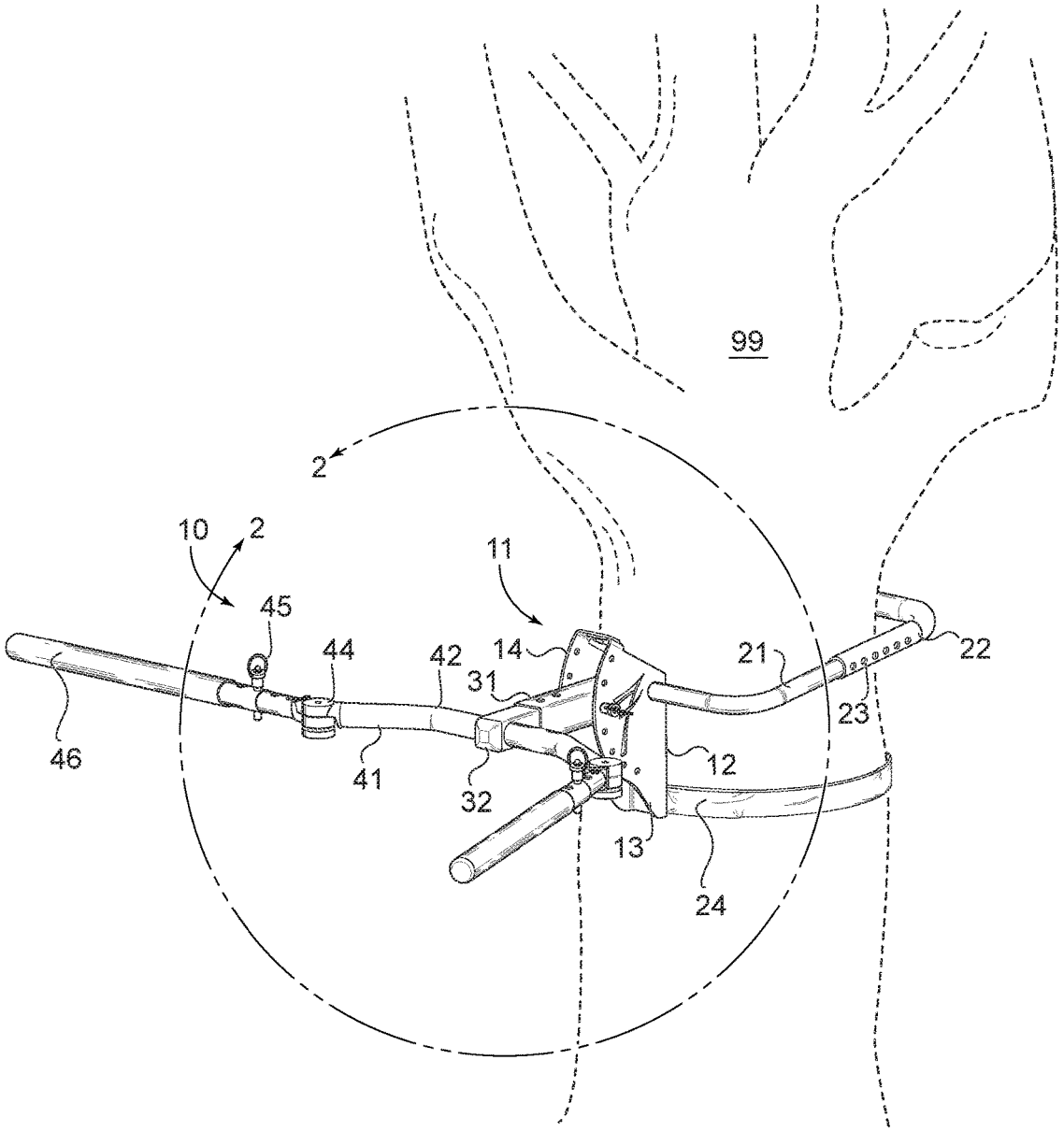
FIG. 1 is a perspective view of a mountable exercise bar assembly.

Initially with regard to FIG. 1, a first preferred embodiment of a mountable exercise bar assembly apparatus 10 of the present invention is shown to a substantially stationary object 99. In the present example, a tree 99 is illustrated, however, the invention is additionally optimally designed to accommodate a pole, a column, a station, a pillar, or the like, whether generally cylindrical, or not, or even rectilinear, as further detailed herein.

Figure 2:
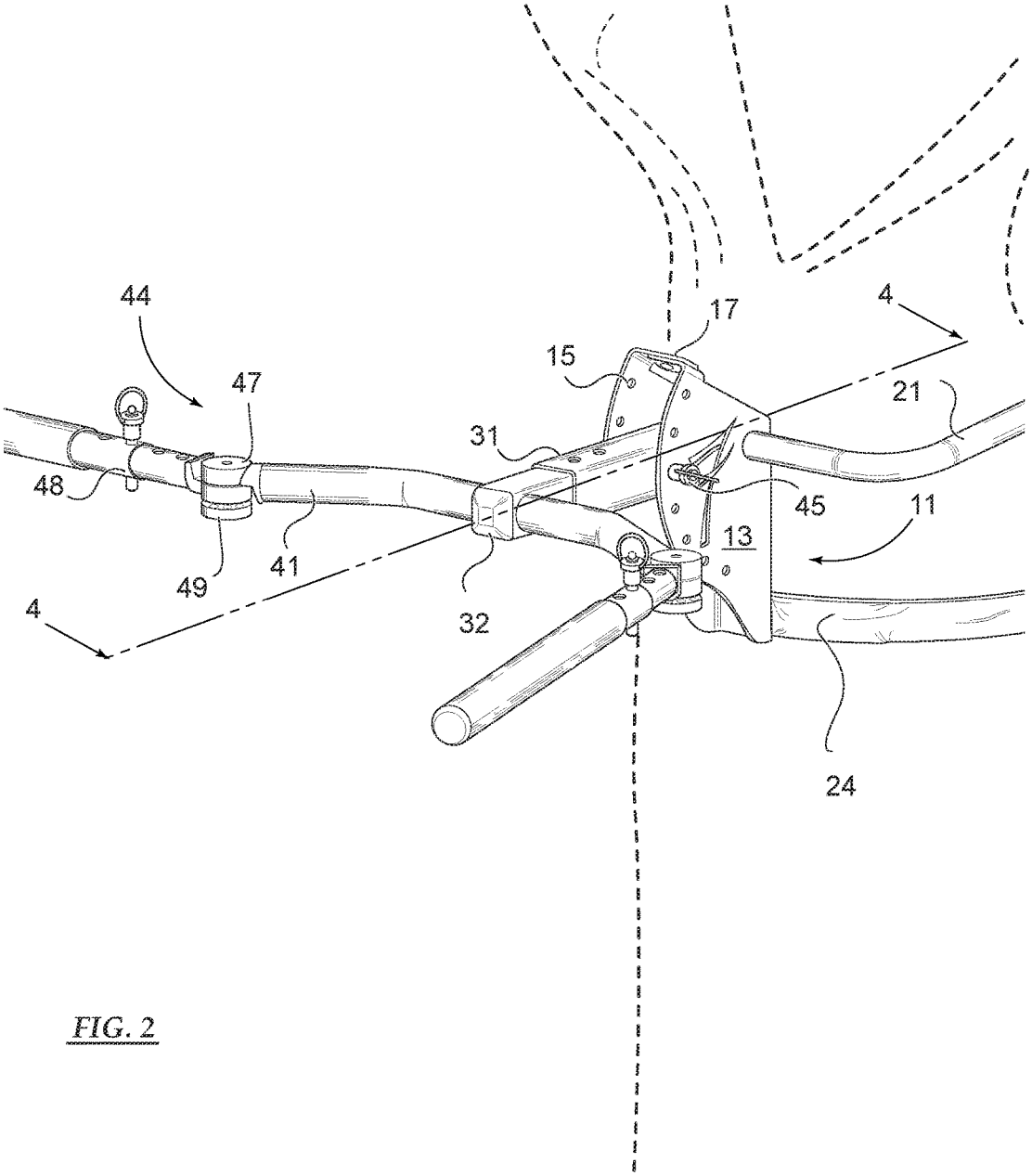
FIG. 2 is an enlarged view about area 2-2 depicted in FIG. 1.

Also as shown with enlarged view, FIG. 2, the center piece of the present invention 10 is its baseplate 11. The baseplate 11 may take many forms however the preferred structure has a substantially flat mating surface 12 for contacting and mating to the stationary object 99. The flat mating surface 11 could additional be curved even though the stationary object 99 may be curved or cylindrical. Hence, it should be appreciated that mating surface 12 could be manufactured curved.

With further regard to the baseplate 11 and FIG. 1 and FIG. 2, extending horizontally out from the baseplate 11 mating portion 12 are a pair of parallel opposing lateral side plates 13, 14. For coupling around a stationary object 99, securing bar 21, 22 is provided connected to the baseplate 11 via the opposing pair of lateral side plates 13, 14. Securing bar 21, 22 has two parts that have a sliding relationship with forward part 21 that slides into the after part 22 wherein holes 23 are provided on each part 21, 22 providing adjustability via a pin 45. A stabilizing strap is provided below the securing bar 21, 22. Hence, the invention may be characterized as a base plate 11 having a rigid structure 21, 22 at an upper portion thereof, at least partially around an upright stationary object and a non-rigid strap at a lower portion thereof around the entirety of the upright stationary object.

An extension arm 31, 32 further connects to the baseplate 11 via the securing bar 21 further wherein the securing bar is a pin fulcrum (FIG. 4) for the extension arm 31, 32. Stated differently, the extension bar 31, 32 rotates about the fulcrum provided by securing bar 21 for optimum vertical adjustment of the exercise assembly device 10. In turn, the baseplate extends horizontally along the first and second lateral side plates 13, 14; except however, this is rotationally adjustable. Specifically, if the illustrated horizontal position can be termed the nine o'clock position, the invention 10 baseplate 11 lateral side plates 13, 14 provide for the extension arm 31, 32 to be rotated past horizontal to the ten and eleven o'clock (approximately) positions and before horizontal to the eight, seven and six o'clock positions; the six o'clock being the straight up and down vertical position.

Still further with regard to FIG. 1 and close-up FIG. 2, an exercise bar 41, 43, in turn, extends substantially laterally from the outwardly extending extension arm 31, 32. The exercise bar 41, 42, 43, 48 is for performing a numerous exercises by a user such as pull ups, chin ups, dips, leg lifts as well as a variety of other exercises and stretches. It should be appreciated that the bar 41, 43 extends out both lateral sides, or just one; and two base plates 11 could be provided or just one.

Figure 5:
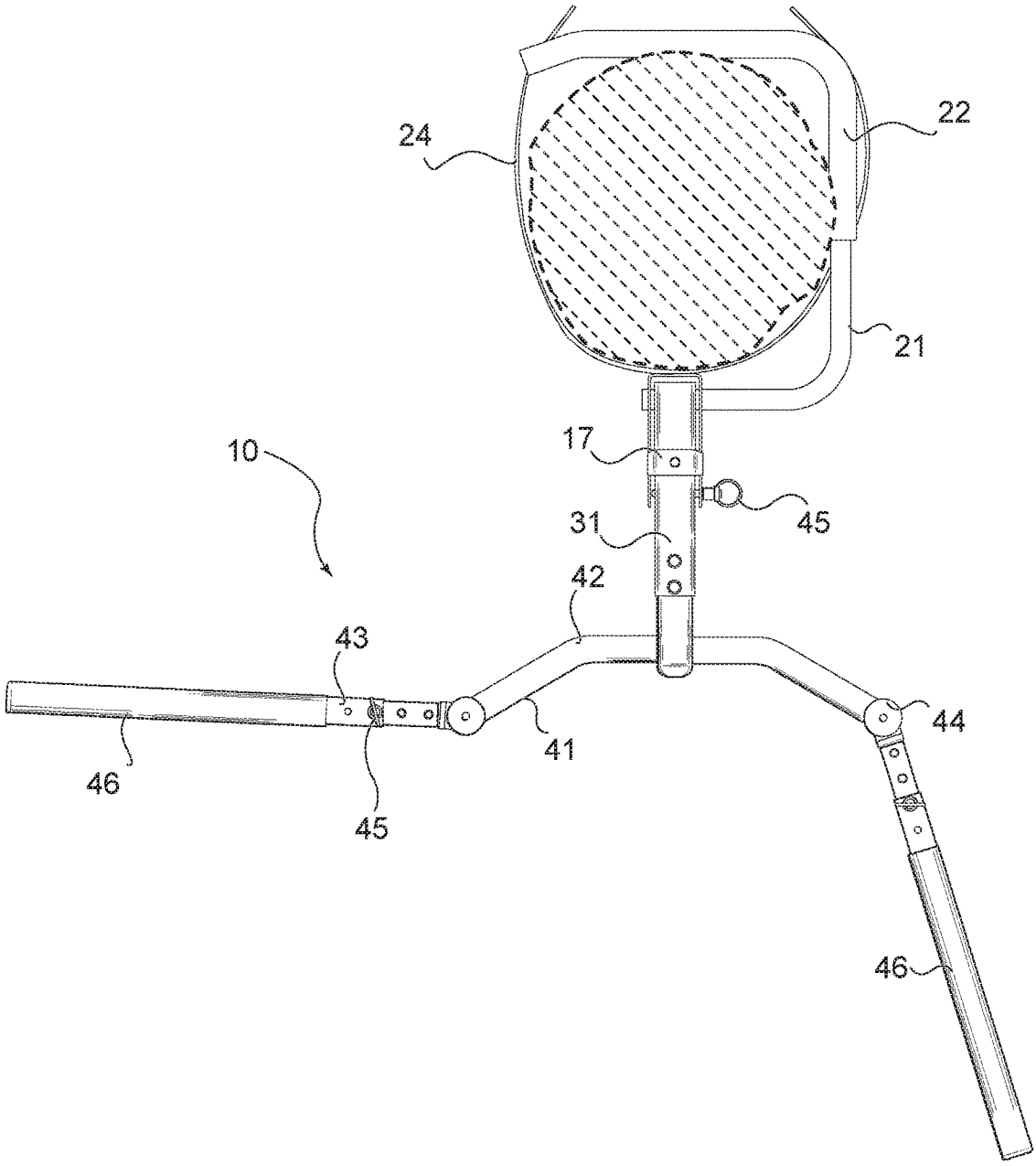
FIG. 5 is a top plan view of the first preferred embodiment.

Additionally with regard to FIG. 1, FIG. 2 and FIG. 5, the extension bar comprises multiple components 41, 42 43, 44, 45, 46, 47, 48 and 49. Specifically, a handle bar section 41 extends laterally with respect to the extension arm 31 32. Elbow portions 42 are included to yield a partially curved shape 41, 42, such as similar in shape to a bicycle handle bar. Attached to the handle bar 41, are additional telescoping hand bar sections 43 and articulating sections 48 on both sides via joints 44. The structure that provides the articulation 44 is initially formed where cylindrical handle bar 41 tapers to a flat surface 47. Articulating section 48 in turn has a flat joint section that slides in relation to flat surface 47. Locking portion 49 has a plurality of pins around and outer periphery thereof locking to selective holes on the respective flat surfaces 47.

Further with regard to FIG. 2, the extension arm 31, 32 more specifically has a first steel tubular extension arm 31 coupled with a second steel tubular extension arm 32 having a telescoping relationship with the first steel tubular extension bar 31. Also, the second bar 32 is slidingly received by the first bar 31 and secured via various holes equally spaced apart that align at various extension lengths. These holes can be appreciated by viewing the top (FIG. 5) and bottom views (FIG. 6) together. And further, pins 45 are used to lock the receiving relationship in place. This relationship 31, 32, is identical to those of relationships 21, 22 and 43, 48 (FIG. 5).

Figure 3:
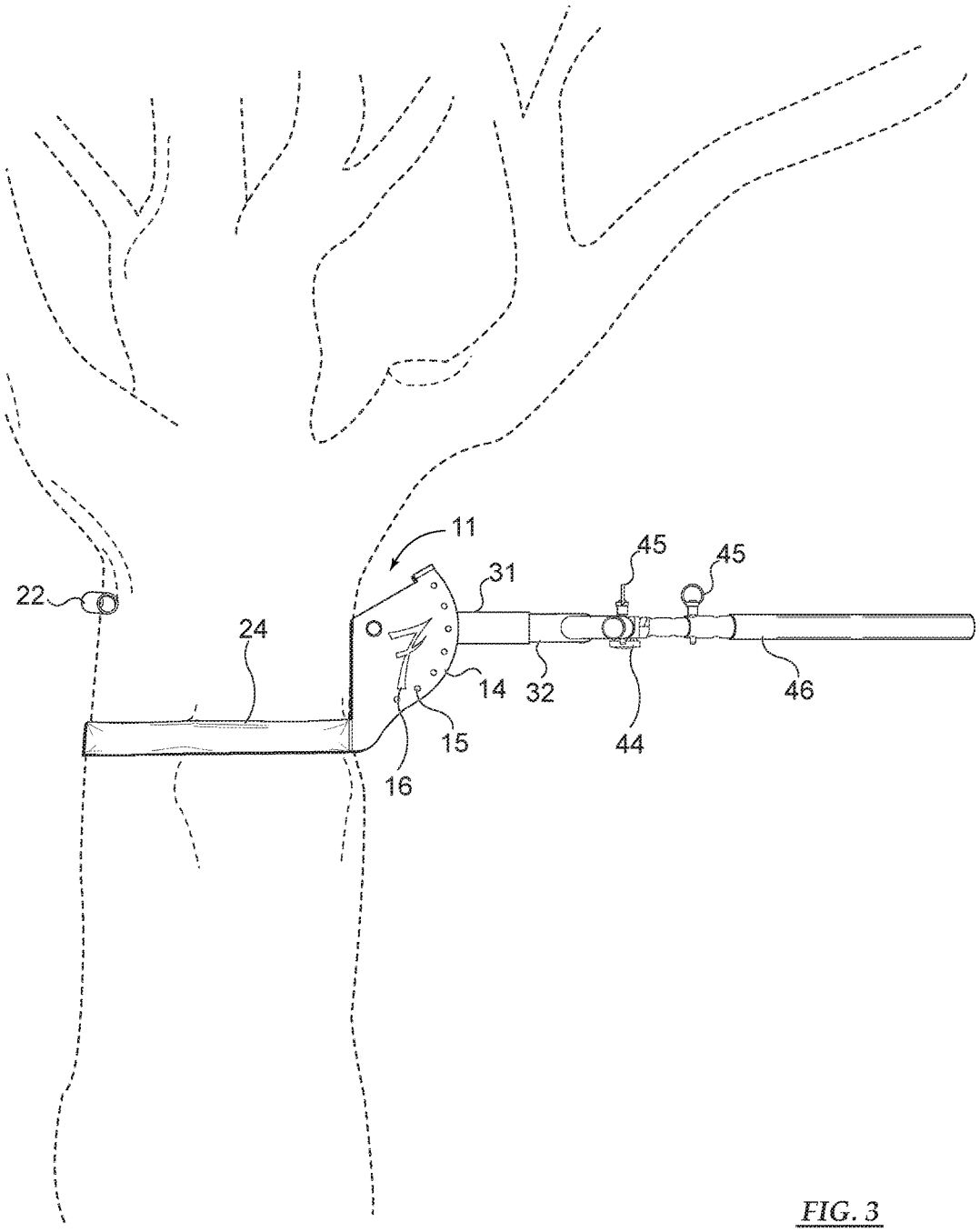
FIG. 3 is profile view thereof.
Figure 4:
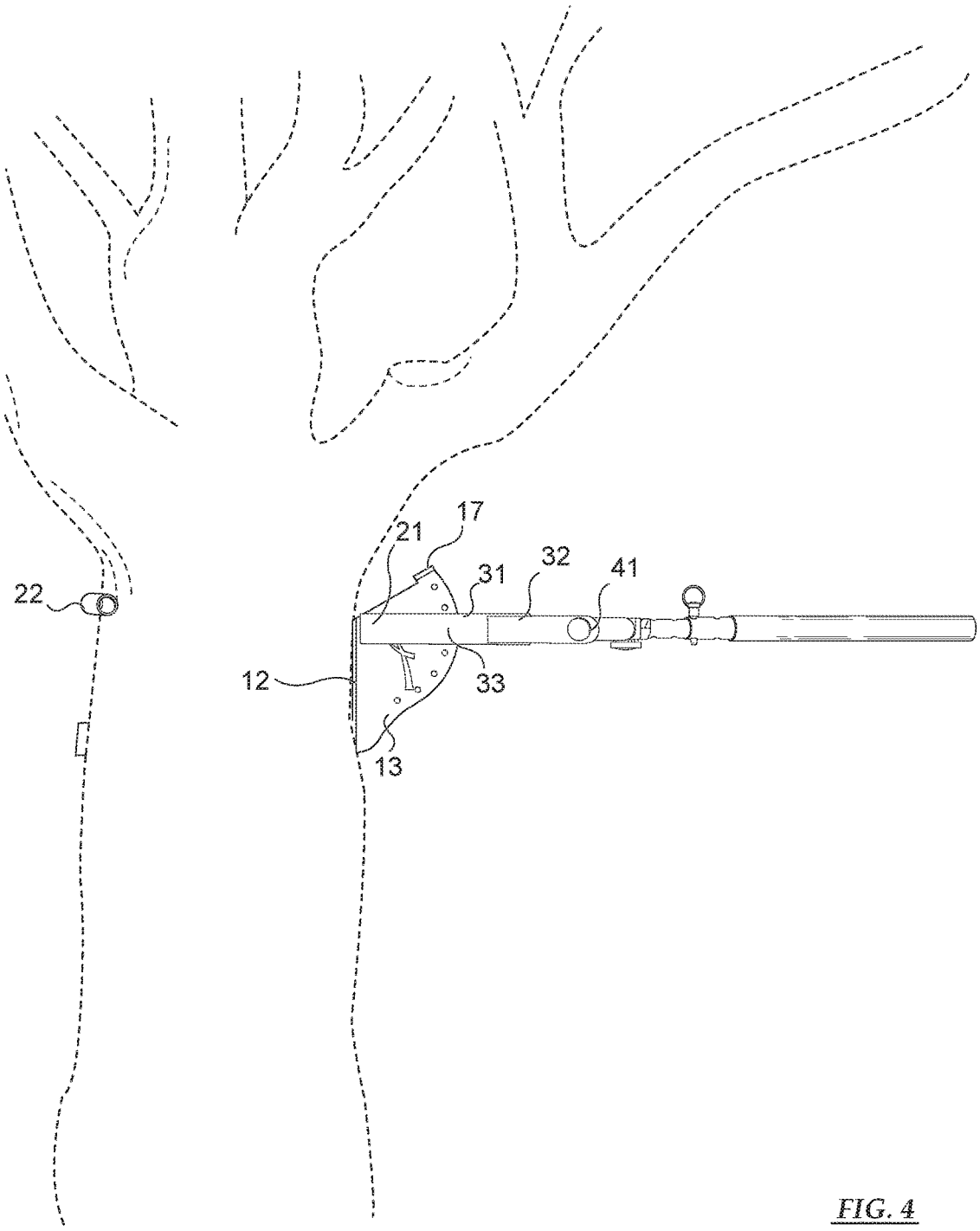
FIG. 4 is a cross-sectional view of the mountable exercise bar assembly taken along line 4-4 in FIG. 2.

FIG. 3 and FIG. 4 illustrates a profile view and a cross-sectional view, respectively. Close inspection of the base plate 11 shows the rotational capabilities of the extension arm 31, 32 using mating holes 15, 33 on the extension arm 31, 32 and lateral sides 13, 14. Another unique aspect is a carve-out 16 to lateral sides 13, 14. The carve-out 16 is ascetically aesthetically pleasing showing the extension arm 31, 32 behind. In a preferred embodiment the carve-out 16 is a scripted number seven that may also serve as a logo or an inventor source identifier.

With reference to FIG. 5, a top plan view of the first preferred mountable exercise bar assembly is shown. As stated, the exercise bar 41, is comprised of multiple components 41, 42 43, 44, 45, 46, 47, 48, 49 for length and aspect adjustability. It should be appreciated that a right side has identical components as a left side. Particularly, a first articulating member 48 is coupled to a first end of the handle bar section 41 via a first joint 44 (left side in the top view FIG. 5); and, a second articulating member 48 is coupled to a second end of the handle bar section 41 via a second joint 44 (right side in the top view FIG. 5). Additionally, a left hand bar 43 is slidingly and adjustably connected to the first articulating member 48 as to selectively extend the left hand bar 43. Similarly, a right hand bar 43 is slidingly and adjustably connected to the second articulating member 48 as to selectively extend the right hand bar 43. Hand grips 46 covering the left and right hand bars 43 are optionally included.

Further regarding FIG. 5 and all the figures, tab 17 is provided to each of the first and second lateral side plates 13, 14 on the base plate 11. The tab 17 is present to allow the lateral side plates 13, 14 to be wielded together for improved structural integrity of the base plate 11. More specifically, each side plate 13, 14 has a tab 17 extending toward one another and contacting each other and wielded or joined together.

Figure 6:
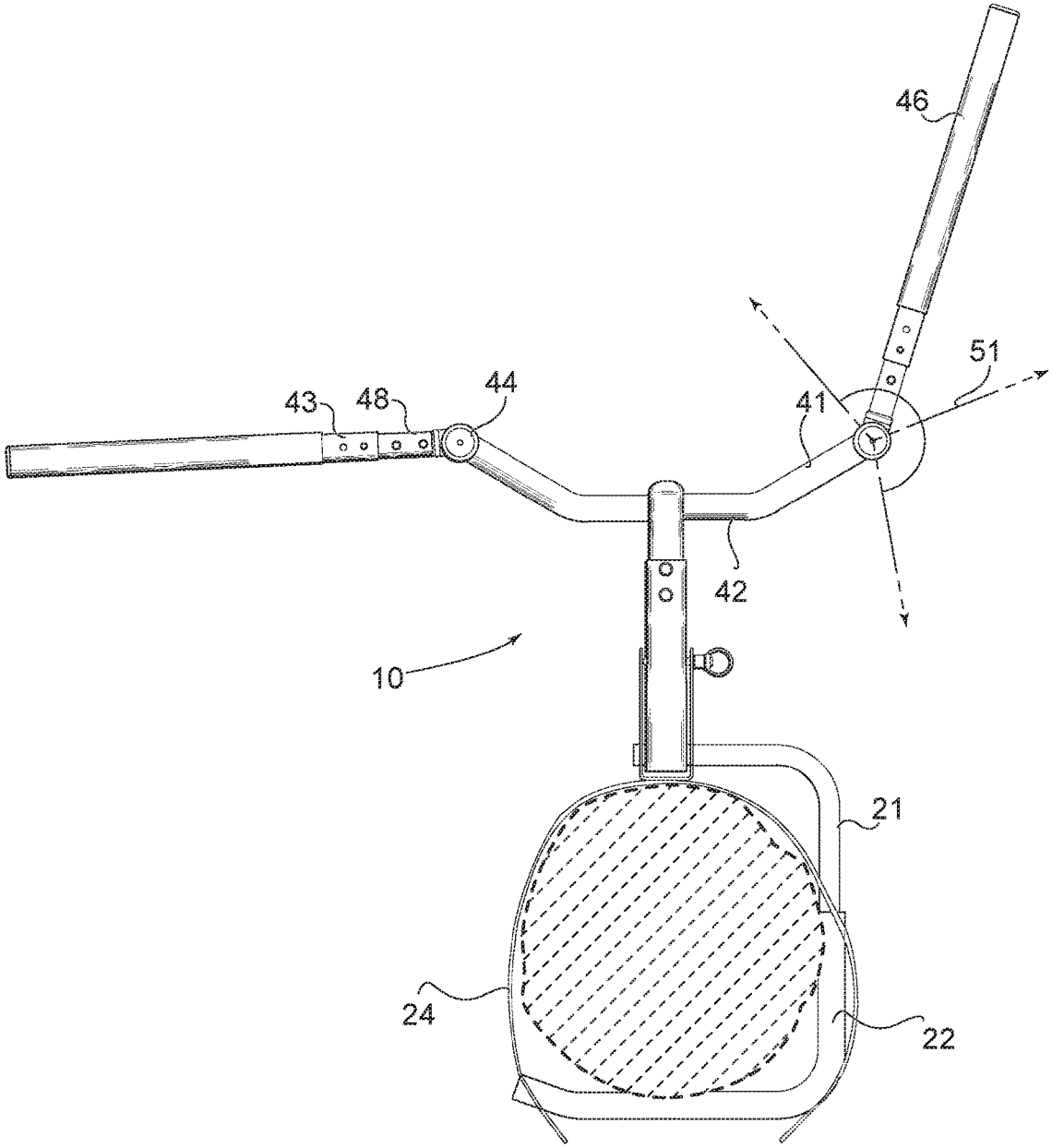
FIG. 6 is a bottom plan view thereof.

FIG. 6 illustrates a bottom view of the first preferred mountable exercise assembly 10. Importantly, the first and second articulating members 48 providing a range of angle adjustment in a top or bottom aspect to the exercise bar. In a preferred embodiment, the range of angle adjustment is 220 degrees. That is, joint 44 provides 110 degrees of angle adjustment on either side of handle bar 41 axis 51.

Additionally with regard to FIG. 6 and all of the figures, securing bar 21 and 22 is generally rectangular in shape and is located above a stabilizing strap 24. The securing bar 21, 22 wraps at least partially around the stationary object 99. As stated, the stabilizing strap 24 is coupled to a lower portion of the base plate 11 (mating surface 12) and extends entirely around the stationary object 99. Stabilizing strap 24 may be secured with a buckle, or a feed through ratchet for tightening and may be comprised of nylon or polyester cargo webbing, for example. Dimensions of the device 10 may vary, however, as an example handle bar 41 has a length of 3 feet and stabilizing strap 24 is approximately 5 to 8 feet long and 1.5 to 3 inches wide. It is further important to note, the exercise bar assembly 10 is made up from several appropriately sized components being detachable for assembly and disassembly, and for stowage and transport, such as in a user's backpack.

While the particular Mountable Exercise Bar Assembly as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A mountable exercise bar assembly for mounting to a substantially stationary object, the mountable exercise bar assembly comprising:

a base plate having a mating surface for contacting and mating to the stationary object;

a securing bar coupled to the base plate and extending at least partially around the stationary object for securing and stabilizing the mountable exercise assembly;

an extension arm extending outwardly from the base plate; and an exercise bar extending laterally and horizontally from the outwardly extending extension arm, the exercise bar configured for performing a plurality of exercises by a user, the exercise bar assembly comprising a plurality of components being detachable for assembly and disassembly and for stowage and transport, the exercise bar further comprising:

a handle bar section extending laterally with respect to the extension arm;

an elbow portion providing a partially curved shape;

a first articulating member coupled to a first end of the handle bar section via a first joint;

a second articulating member coupled to a second end of the handle bar section via a second joint;

a left hand bar slidingly and adjustably connected to the second articulating member as to selectively extend the left hand bar; and a right hand bar slidingly and adjustably connected to the second articulating member as to selectively extend the right hand bar, the first and second articulating members providing a range of angle adjustment.

2. The mountable exercise bar assembly of claim 1, the base plate further comprising a parallel pair of opposing lateral side plates extending outwardly from the mating surface, wherein the securing bar is connected to the base plate via the opposing pair of lateral side plates and wherein the extension arm connects to the base plate via the securing bar, wherein the securing bar is a pin fulcrum for the extension arm, the extension arm further rotating about the fulcrum, providing vertical adjustment to a user wherein a rotation is locked in place.

3. The mountable exercise bar assembly of claim 2, the pair of opposing lateral sides each comprising a carve out, the carve out further comprising a source identifier.

4. The mountable exercise bar assembly of claim 1, the extension arm further comprising:

a first steel tubular extension arm; and a second steel tubular extension arm having a telescoping relationship with the first steel tubular each having a plurality of holes equally spaced apart that align at various extension lengths.

5. The mountable exercise bar assembly of claim 1, further comprising a stabilizing strap coupled to a lower portion of the base plate and extending entirely around the stationary object and further wherein the stabilizing bar is configured above the stabilizing strap.

6. The mountable exercise bar assembly of claim 1, the opposing pair of lateral side plates each comprising a tab extending toward one another and contacting each other and welded together providing additional structural integrity to the base plate.

7. The mountable exercise bar assembly of claim 1, wherein the extension arm further comprises a pin fulcrum coupling between the extension bar and the base plate and providing rotational adjustment to the extension arm, and wherein the pin fulcrum coupling further provides for the extension arm to rotate past horizontal.

8. A mountable exercise bar assembly for mounting to a substantially stationary object, the mountable exercise bar assembly comprising:

a base plate having a flat mating surface for contacting and mating to the stationary object;

an extension arm extending outwardly from the base plate;

an exercise bar extending laterally and horizontally from the outwardly extending extension arm, the exercise bar configured for performing a plurality of exercises by a user, the exercise bar assembly comprising a plurality of components being detachable for assembly and disassembly and for stowage and transport;

the base plate further comprising a parallel pair of opposing lateral side plates extending outwardly from the base plate flat mating surface, the extension arm being configured between the pair of opposing lateral side plates; and the exercise bar further comprising:

a handle bar section extending laterally with respect to the extension arm;

an elbow portion providing a partially curved shape;

a first articulating member coupled to a first end of the handle bar section via a first joint;

a second articulating member coupled to a second end of the handle bar section via a second joint;

a left hand bar slidingly and adjustably connected to the second articulating member as to selectively extend the left hand bar; and a right hand bar slidingly and adjustably connected to the second articulating member as to selectively extend the right hand bar, the first and second articulating members providing a range of angle adjustment.

9. The mountable exercise bar assembly of claim 8 further comprising a securing bar coupled to the base plate and extending at least partially around the stationary object for securing and stabilizing the mountable exercise assembly.

10. A mountable exercise bar assembly for mounting to a substantially stationary object, the mountable exercise bar assembly comprising:

a base plate having a flat mating surface for contacting and mating to the stationary object;

an extension arm extending outwardly from the base plate;

an exercise bar extending laterally and horizontally from the outwardly extending extension arm, the exercise bar configured for performing a plurality of exercises by a user, the exercise bar assembly comprising a plurality of components being detachable for assembly and disassembly and for stowage and transport;

a pin fulcrum coupled to the extension arm, the pin fulcrum providing the extension arm to rotate past a horizontal position; and the exercise bar further comprising:

a handle bar section extending laterally with respect to the extension arm;

an elbow portion providing a partially curved shape;

a first articulating member coupled to a first end of the handle bar section via a first joint;

a second articulating member coupled to a second end of the handle bar section via a second joint;

a left hand bar slidingly and adjustably connected to the second articulating member as to selectively extend the left hand bar; and a right hand bar slidingly and adjustably connected to the second articulating member as to selectively extend the right hand bar, the first and second articulating members providing a range of angle adjustment.

11. The mountable exercise bar assembly of claim 10, wherein the base plate further comprises a parallel pair of opposing lateral side plates extending outwardly from the base plate flat mating surface, the extension arm configured between opposing lateral side plates via the pin fulcrum.

* * * * *